US005862524A

United States Patent [19]

Case

[11] Patent Number: 5,862,524

[45] Date of Patent: Jan. 26, 1999

[54] CAP STRAP ATTACHMENT

[76] Inventor: Robert P. Case, 13372 Santa Fe Line, Wapakoneta, Ohio 45895

[21] Appl. No.: 773,076

[22] Filed: Dec. 26, 1996

[51] Int. Cl.[6] ..... A42B 1/24

[52] U.S. Cl. ..... 2/209.13; 2/244; 40/329

[58] Field of Search ..... 2/209.13, 195.2, 2/244; 40/329

[56] References Cited

U.S. PATENT DOCUMENTS

| | | | |
|---|---|---|---|
| 4,872,218 | 10/1989 | Holt | 2/209.13 |
| 5,287,559 | 2/1994 | Christiansen et al. | 2/209.13 |
| 5,418,981 | 5/1995 | Miner | 2/209.13 |
| 5,533,213 | 7/1996 | Reiner et al. | 2/209.13 |

*Primary Examiner*—Diana L. Biefeld
*Attorney, Agent, or Firm*—Standley & Gilcrest

[57] ABSTRACT

My invention, the "Hat Bob", is designed to be an independent clothing accessory item that will "fit over" the closure or adjusting strap found on the back of most "ball type" caps and hats. It's main purpose is the "cover" the opening in the back of a hat or cap above the closure or adjusting strap. It could be constructed of common materials, such as, but not limited to, cloth, plastic, vinyl, etc. It would attach securely onto the back of a hat or cap using common fastening devices, such as, but not limited to, velcro, snaps, loops, etc.(see Enclosure 7: Materials List). One of the previously mentioned designs can be constructed so that a "hidden pocket" can be formed into the "backing" of the "Hat Bob". The "Hat Bob" is easily detachable to launder or attach to another hat or cap. The benefits of the "Hat Bob", although not limited to, could include practical protection from sun, wind, rain, cold, dust, bugs, etc. The outside or facing of the "Hat Bob" provides a convenient space for advertising, display of team or organizational logos, personalized designs, emblems, numbers, fad identity, display of color, and other imaginative creations. In addition to practical applications, I think people who are inclined to wear their hats "backwards" would find a "Hat Bob" an attractive and comfortable hat accessory.

4 Claims, 7 Drawing Sheets

CAP STRAP ATTACHMENT

BACKGROUND OF THE INVENTION

The "field of art" would most likely be related to fashion design, sports wear, wearing apparel, clothing accessory, faddish trends, or advertising. To the best of my knowledge, no such product or design now exists that fits over the opening in the rear of a hat or cap for the purpose of added comfort, advertising, decoration, etc. I conceived the idea when I used a piece of matching cloth to cover the opening on one of my own caps to keep the wind from blowing in on my "balding" head; people noticed it, so I thought about then adding a slogan or sports symbol onto it. I thought about a pocket to keep car keys or money in, when I found myself kayaking, wearing only a T-shirt and swimming suit with no pockets available. Thus, I decided to apply for a patent.

BRIEF SUMMARY OF THE INVENTION

A "Hat Bob" is an object designed to fit over the opening on the back of a hat or cap, usually attaching over the closure or adjusting strap. The useful purposes could include, but not limited to: advertising, decoration, display of team or organizational logos, added weather protection from wind or sun, a "fad trend", and availability of different pockets. The material used for construction could be cloth, plastic, vinyl, or other such type material. The fastening devices could include velcro hook and loop tape, snaps, loops, or other such type fasteners. In summary, this invention can be economically constructed of common materials, and provide added weather protection, a pocket, and distinctive styling (such as advertising or designs) to a ball-type hat or cap.

BRIEF DESCRIPTION OF THE DRAWINGS

FIG. 6*a* shows a one piece construction where the material body is folded over and stitched at line 1 to form a casing 2 for the hat's closure strap to slide through.

DETAILED DESCRIPTION OF THE INVENTION

Figure 1A:
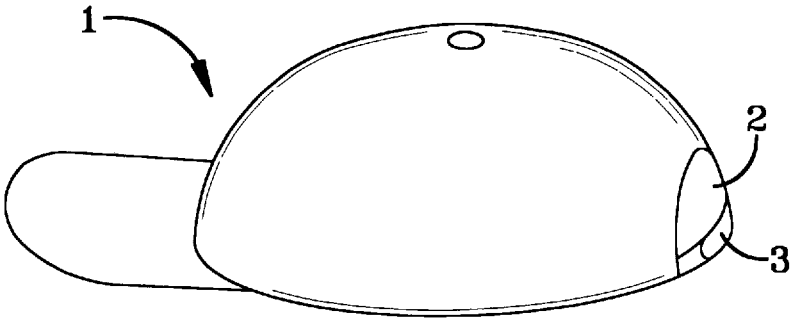
FIG. 1*a* is a side view of a hat or cap, showing the bill 1 as the front, and the opening 2 with a closure strap 3, as the rear.

FIG. 1*a* shows a "side" view of a common piece of headgear that I will refer to as a hat or cap. The bill 1 is normally worn toward the front of a person's head, but is often now worn "backwards" toward the rear of a person's head. Therefore, the opening 2 of the hat, and the closure strap 3 could face any direction the wearer chooses. My "Hat Bob" invention will attach over the closure strap 3 and cover the hat's opening 2.

Figure 1B:
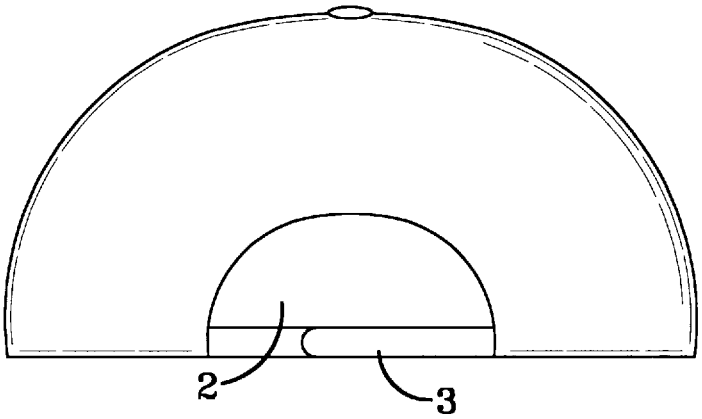
FIG. 1*b* is a rear view, again showing the opening 2 and the closure strap 3.

FIG. 1*b* shows a "rear" view of a hat with locations of opening 2 and closure strap 3 exposed. Note—the wearer's head is exposed to dirt, sun, wind, cold, bugs, etc.; plus, the opening serves little, if any function.

Figure 1C:
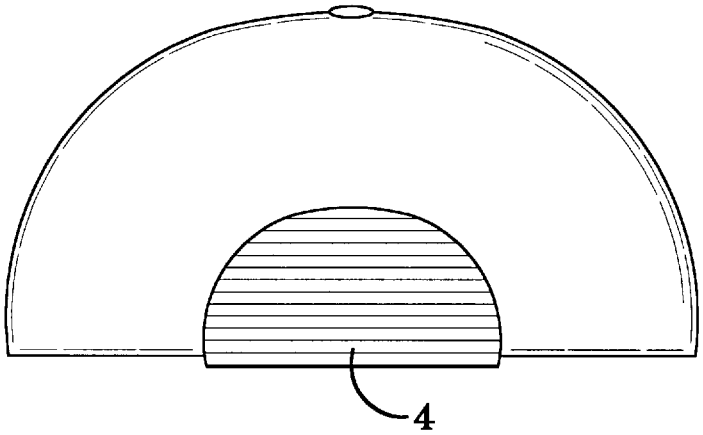
FIG. 1*c* is a rear view, showing the location of a "Hat Bob" 4 covering the opening 2(now hidden) and closure strap 3(now hidden).

FIG. 1*c* demonstrates the effect of a "Hat Bob" 4 attached over (now hidden) opening 2 and closure strap 3. Hat now is "improved" by sealing out weather and foreign materials, can possess a pocket, and has an area the size of the opening or larger for any kind of art, advertising, decoration, logo, etc. to be displayed upon.

Figure 2:
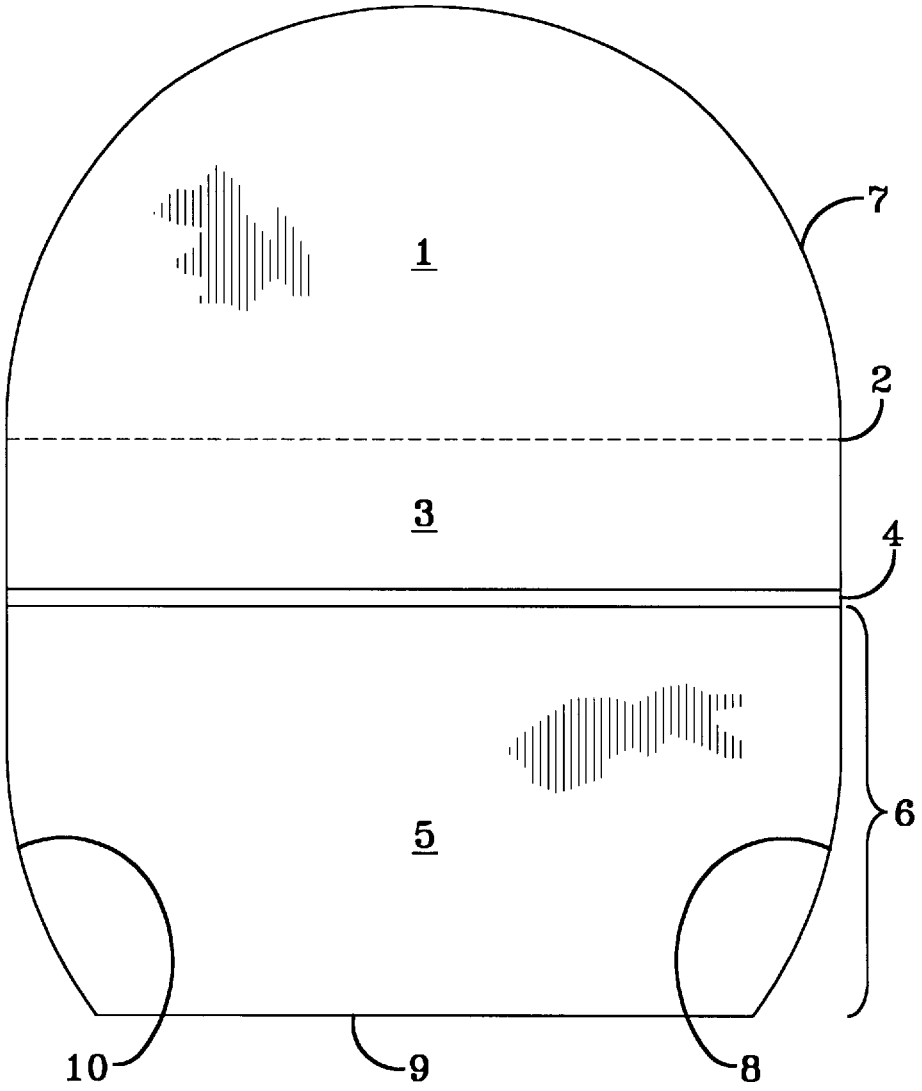
FIG. 2 shows an "inside" view of a "Hat Bob", where the fastening devices can be attached. This drawing is approximately the actual size needed to cover the opening on a typical hat: 4" wide by 5" high, as viewed "open"; folded (finished) size would be 4" wide by 3" high. The construction includes: hook and loop fastening tape 1 & 5, stitching line 2, exposed body 3, fold line 4, plus suggested distance 6, serged edges 7, and stitched edges 8-9-10; note that the lower hook and loop tape is not stitched across the fold line 4(this area forms a "hidden pocket" behind fastening tape 5).

FIG. 2 shows an "inside" view of a "Hat Bob" demonstrating one particular size, shape, and construction method. This drawing is approximately the size and shape needed to minimally cover a hat's opening. The approximate size as viewed "open" is 5" high by 4" wide; the "folded or attached" size would be approximately 3" high by 4" wide. This "Hat Bob" would use heavy cloth or denim as its main body 3. The outside edges 7 would be serged or finished to prevent fraying, plus improve its appearance. One piece velcro hook and loop fastening tape(2"×4") will be used as the fastening device; "loop" side 1 attached to the top, and stitched across the stitching line 2, with "hook" side 5 stitched along edges 8-9-10, but not across the fold line 4(this portion forms a "hidden pocket" 6). When the "Hat Bob" is folded at line 4, the pocket 6 seals shut to prevent items from falling out. To attach this "Hat Bob" to a hat, fold it at the fold line 4 over the hat's closure strap, fastening the "hook" portion of tape 5 against the "loop" portion 1; the ¾" to 1¼" exposed portion of body 3 becomes a "casing", allowing enough space to fold over a hat's closure strap.

This procedure will secure the "Hat Bob" over the hat's closure strap and fit over the outside of the hat's opening. The "fold line" 4 should be approximately 2" up from the bottom edge 9, allowing the lower portion 5 to fold up and slightly overlap upper portion 1. This method of attachment has been tested using a prototype which successfully "hugged" the back of the hat, remained firmly in proper position, and was deemed to be attractive by several viewers.

Figure 3:
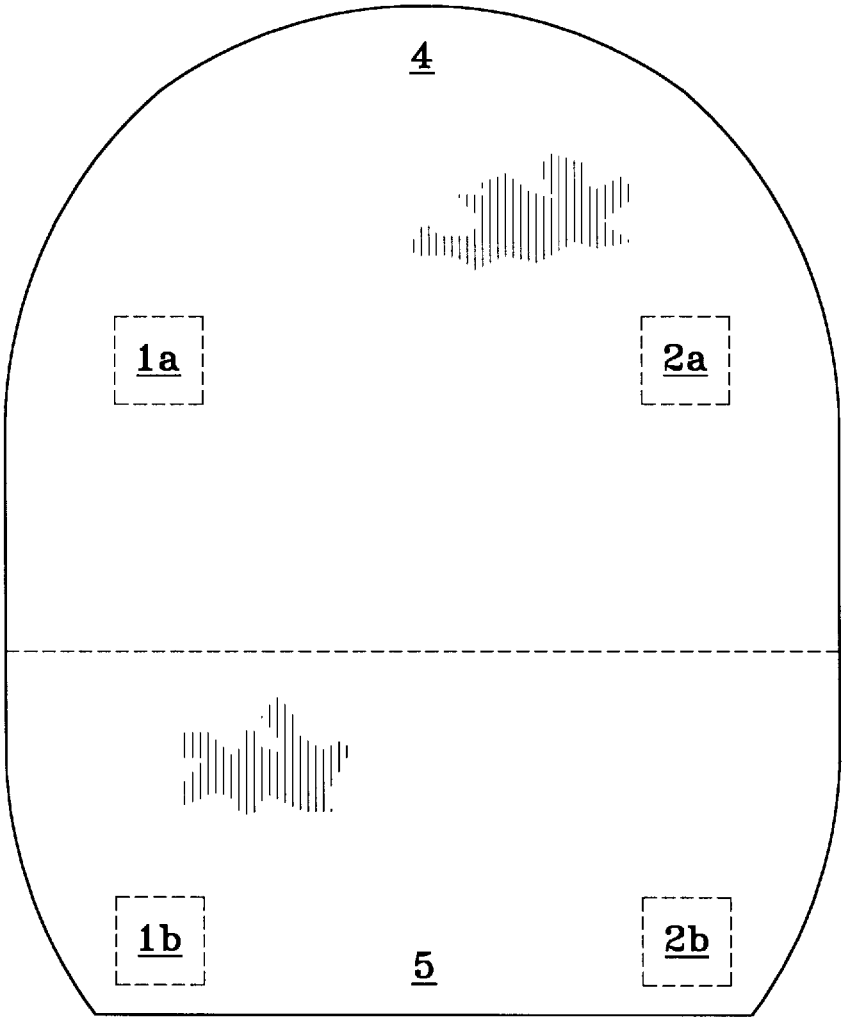
FIG. 3 shows an "inside" view of a "Hat Bob", providing a different method of attaching it to a hat. A set of any type "female" fasteners could be attached at or near points 1*a* & 2*a*, while any matching type "male" fasteners could be attached at or near points 1*b* & 2*b*(note: the sequence could obviously be reversed). Bottom 5 would fold up at "fold line" 3 (approximately 1¾" up from bottom) toward top 4, aligning and securing fasteners over a hat's closure strap.

FIG. 3 shows another inside view of a "Hat Bob", providing a different method of attaching it. This drawing is approximately the size needed to minimally cover the hat's opening. The shape could vary. This size, of approximately 5" high and 4" wide could be smaller to "tuck" into the hat's opening, or larger to provide more space for design advertising or an unusual shape, such as team emblems. Construction of this style "Hat Bob" could use any type of material and fasteners(see Enclosure 8: Materials List). A set of any type "male" fasteners would be attached at or near points 1*b* and 2*b*(¼" up from the bottom and centered 3" apart). A corresponding set of "female" fasteners would be attached at or near points 1*a* and 2*a*, approximately 3"up from center points of the "male" fasteners and aligned vertically. To attach this "Hat Bob" to a hat, face the inside toward the rear of the hat and fold bottom 5 up and over the hat's closure strap, attaching lower "male" fasteners 1*b* and 2*b* onto upper "female" fasteners 1*a* and 2*a*. A "fold line" approximately 1¾" up from bottom 5 could be drawn on the back of the body to assist in proper alignment, but is not necessary, as the hat's closure strap will be inside this casing area formed between the fasteners. This style "Hat Bob" will also fit securely and "hug" the back of the hat, apparently due to the curvature of the hat closure strap pulling it in toward the back of the hat.

Figure 4:
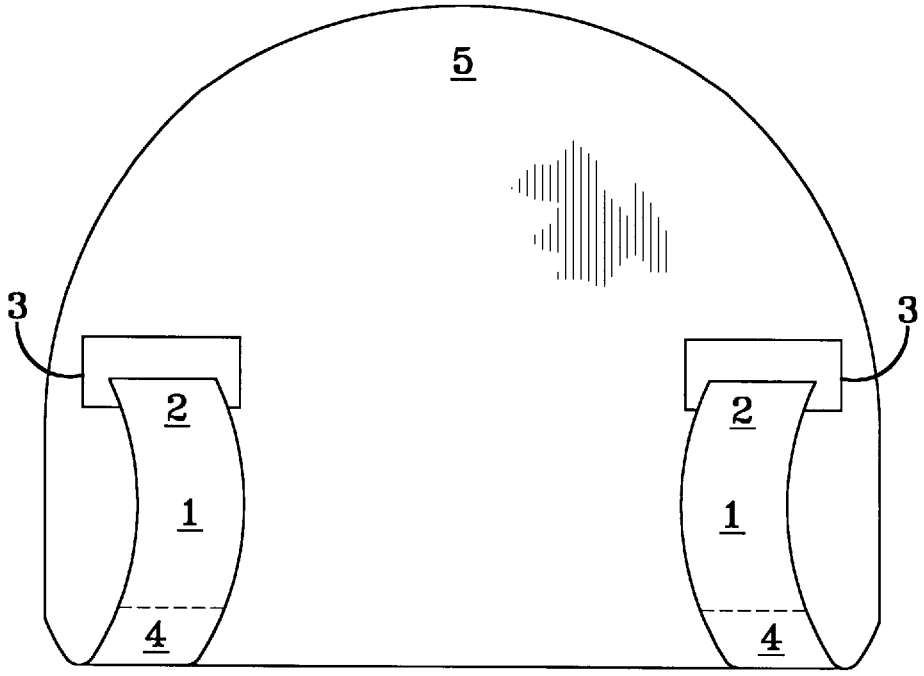
FIG. 4 shows and "inside" view of another "Hat Bob" variation, using elastic straps 1 attached to bottom edge 4; the other ends of the straps 2 would have a set of "male" fasteners attached to align with a set of "female" fasteners 3. Using this attaching method can allow top and side edges 5 to be inserted inside the hat opening.

FIG. 4 is another example of a construction variation, using elastic straps 1 approximately ¾" wide and 1¼" long. The straps 1 are attached to the bottom edge 4 of this "Hat Bob", while the loose ends 2 would have a set of "male" fasteners attached to them. A matching set of "female" fasteners would be attached approximately 1¼" up from the bottom edge and aligned vertically with attached ends 4 of the elastic straps. Straps 1 could also be of similar materials (see Enclosure 8: Materials List). To attach to a hat, face the inside of this "Hat Bob" toward the back of the hat, and pull the straps 1 over the hat's closure strap, attaching fasteners 2 to fasteners 3. Using this attaching method would also allow the outside edges 5 to be inserted or "tucked" inside the hat's opening, providing a different appearance or function.

Figure 5:
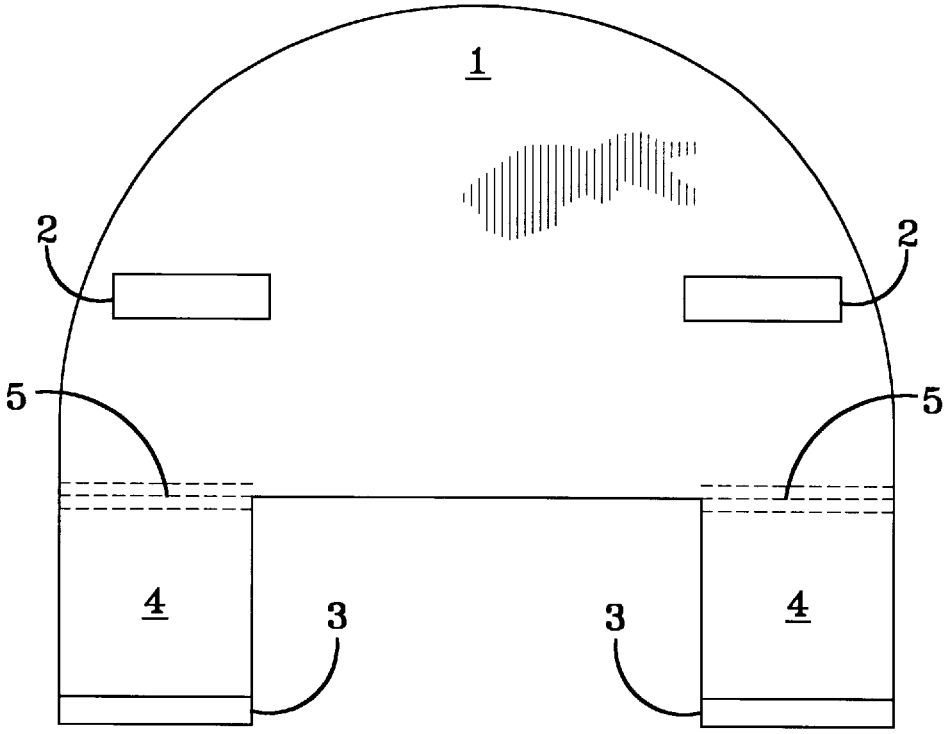
FIG. 5 shows an "inside" view of another variation of a "Hat Bob" design where the body 1 can be constructed on one piece of material. The tabs 4 would have any "male" type fastener attached at their ends 3 to fold up over a hat's closure strap, attaching to matching "female" fasteners 2. The tabs 4 would pivot or fold up on either hinged pins or grooved slots 5 to secure over a hat's closure strap.

FIG. 5 is intended to demonstrate another construction variation of a "Hat Bob" constructed of one piece of material, possibly plastic or some other "stiffer" material(see Enclosure 8: Materials List). The overall height would be approximately 4¼" and the width approximately 3½" to 4", with the fastening tabs 4 being approximately 1¼" long and 1 to 1½" high. The tabs 4 could have any type "male" fastener attached at their ends 3, with matching "female" fasteners attached approximately 1¼" up from "hinges" 5, and aligned vertically with "male" fasteners 3. In this case, since the body 1 could be plastic, the pivot hinged area 5 could be constructed of actual pined hinges, or just a "crease lines" in the plastic to allow for the tabs 4 to be folded up where the "male" fasteners would align and attach to the "female" fasteners 2. The tabs 4 would "clamp-over" the hat's closure strap, securing the "Hat Bob" against the rear of the hat.

Figure 6A:
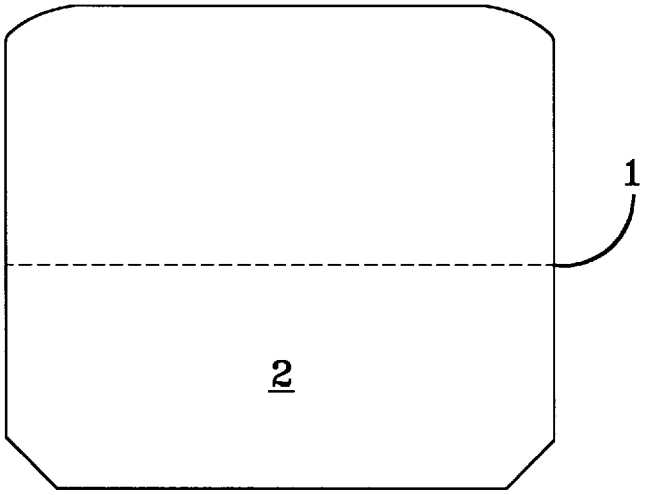

FIG. 6*a* shows a "one piece" construction where the material body is folded over at "stitch line" 1 to form a casing 2 for the hat's closure strap to slide through. This could be either a front or rear view.

Figure 6B:
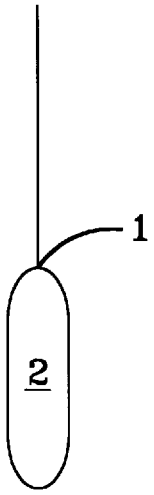
FIG. 6*b* is a "side" view of FIG. 6*a*, showing the casing 2 that is formed when the material of the body is folded and stitched at line 1.

FIG. 6*b* is a "side" view of FIG. 6*a*, showing the casing 2 that is formed when the material of the body is folded up and stitched at line 1. The height of the casing 2 would only need be sufficient to allow the passage of a hat's closure strap.

Figure 7:
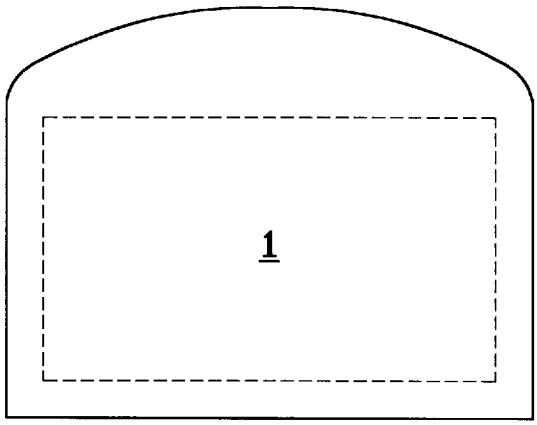
FIG. 7 shows a design and size variation with an "outside pocket" 1.

FIG. 7 shows a design and size variation, along with an "outside" pocket 1, attached by stitching around 3 edges.

Figure 8:
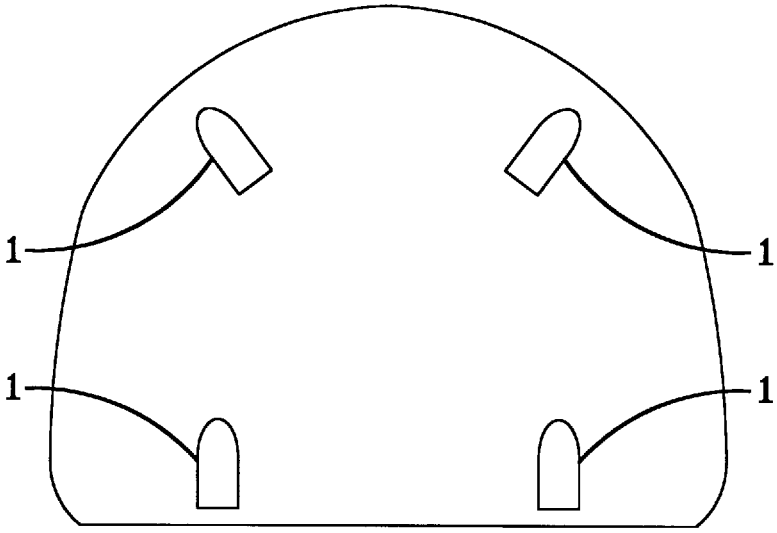
FIG. 8 is another "inside" view showing attaching devices 1 as "clips or grippers" that simply slide over a hat's closure strap at the bottom and slide over the hat's fabric around the opening at the top.

FIG. 8 is another "inside" view showing a variation in fastening devices, using "clips or grippers" 1 that would simply slide over the hat's closure strap at the bottom and over the hat's fabric around the opening near the top.

Figure 9:
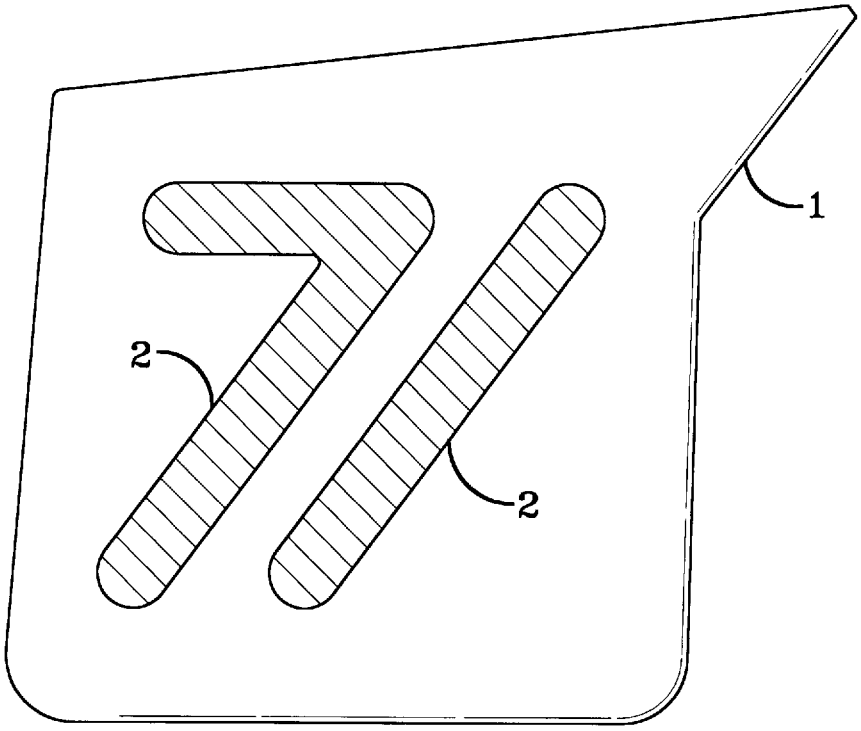
FIG. 9 is an "outside" view of a "Hat Bob" design variation illustrated by shape 1, and an example of an individual's own team number 2. This design demonstrates that the size and shape of a "Hat Bob"0 is not limited to only covering the hat's physical opening.

FIG. 9 shows an "outside" view of an "oversized" and "uniquely shaped" "Hat Bob", just to demonstrate that the design is not limited to just physically covering a hat's opening and closure strap. This example shows both a design variation 1, and a purpose or function variation 2. The oversized and unique shape 1 could be a duplication or an actual team logo, while the number "71" 2 could represent one of that team's players. Numbers or names could also be "personalized" by individuals for their own use, along with any combinations of shapes, sizes, colors, inscriptions, etc.

I claim:

1. An attachment to fit over the adjustment strap of a hat or cap having an adjustment strap, said attachment comprising:

a material piece having a first side and a second side, and adapted to be folded over at a fold line so as to be folded over said adjustment strap of a cap;

said first side being provided with a hook-and-loop fastener; a portion of said first side on one side of said fold line having a hook portion of said hook-and-loop fastener, and a portion of said first side on the other side of said fold line having a loop portion of said hook-and-loop fastener, said hook portion of said hook-and-loop fastener having edges defining a periphery thereof, a portion of said periphery aligned along said fold line, and being attached to said first side along said edges except for said portion of said periphery aligned along said fold line, so as to form a pocket with said material piece.

2. An attachment according to claim 1 wherein said material piece comprises a material selected from the group consisting of cloth, plastic and vinyl.

3. An attachment according to claim 1 wherein said second side is provided with indicia selected from the group consisting of logos, slogans and names.

4. In combination, a cap having an adjustment strap, and an attachment according to claim 1, attached to said adjustment strap by being folded over said adjustment strap such that said hook-and-loop fastener closes said material piece about said adjustment strap.

* * * * *